United States Patent [19]

Greiler

[11] 4,423,348

[45] Dec. 27, 1983

[54] COMBINED HIGH PRESSURE DISCHARGE LAMP AND REFLECTOR ASSEMBLY

[75] Inventor: Wolfgang Greiler, Unterhaching, Fed. Rep. of Germany

[73] Assignee: Patent-Treuhand-Gesellschaft für elektrische Glühlampen mbH, Munich, Fed. Rep. of Germany

[21] Appl. No.: 297,359

[22] Filed: Aug. 28, 1981

[30] Foreign Application Priority Data

Sep. 8, 1980 [DE] Fed. Rep. of Germany ..... 3033688

[51] Int. Cl.[3] ..... H01J 61/40; F21V 7/20; F21V 29/00

[52] U.S. Cl. ..... 313/113; 362/264; 362/294; 362/345; 362/373

[58] Field of Search ..... 313/113; 362/264, 265, 362/345, 373, 294

[56] References Cited

U.S. PATENT DOCUMENTS 3,700,881 10/1972 Slomski ..... 362/265
4,290,097 9/1981 Block et al. ..... 362/264

*Primary Examiner*—Palmer C. Demeo

*Assistant Examiner*—Sandra L. O'Shea

*Attorney, Agent, or Firm*—Frishauf, Holtz, Goodman and Woodward

[57] ABSTRACT

A lamp assembly comprises a high pressure discharge lamp and reflector which are secured together as a structural unit. An insulating base is connected to the neck end of the reflector and to the lamp, and a front end ring is connected to the front, light emitting end of the lamp and reflector assembly. A pair of electrical connection members, preferably in the form of pins, are associated respectively with the base and end ring and are rigidly connected to the respective associate base and end ring. The connection members are electrically connected to respective ends of the lamp, the lead-in wire of the lamp and the front or light emitting end of the structure extending from the lamp substantially radially to at least one of the reflector and end ring and then extending directly to the connection member associated with the end ring. Preferably, the lead-in wire at the front end of the structural unit acts as a support and adjustment or locating member of the lamp. A further substantially rigid radially extending connection member may be provided, as desired.

12 Claims, 3 Drawing Figures

COMBINED HIGH PRESSURE DISCHARGE LAMP AND REFLECTOR ASSEMBLY

BACKGROUND OF THE INVENTION

This invention relates to an assembly comprising a high pressure discharge lamp and a reflector as a structural unit and more particularly to such an assembly in which the lamp is arranged with its longitudinal axis located on the reflector axis. The assembly has a base at the rear end and an end ring at the front or light emitting end thereof, which hold and locate the lamp and which provide vent openings for cooling of the lamp.

An assembly of this general type is already known from DE-OS No. 28 40 031 to which U.S. Pat. No. 4,290,097, U.S. Ser. No. 066,664, filed Aug. 15, 1979, Werner Block, et al., assigned to assignee of this invention, corresponds. In DE-OS No. 28 40 031, the lead-in wire connected to the second lamp end, i.e., the lamp end facing the light emission aperture of the reflector, is designed as a heat dissipating metal strip which is passed radially to the end ring and loosely once about the inner wall of the end ring. The lead-in wire is further passed through an opening to the exterior of the reflector where it is joined to the connection member without a specific position being fixed for it. The connection member at the base is illustrated in the example as a bushing so that the respective cooperating contract supply high voltage is at least partially an uninsulated pin, which should be avoided for security reasons.

Lamps to which the present invention pertains are particularly useful in projectors such as movie projectors, slide projectors, etc.

The present invention seeks to improve over the prior art by providing an assembly comprising a high pressure discharge lamp and a reflector as a structural unit in which the connection members are of a secure design both electrically and mechanically and are attached to the associated base and end ring in a space-saving manner; and in which good heat dissipation is ensured.

SUMMARY OF THE INVENTION

In accordance with the invention, a lamp assembly comprises a high pressure discharge lamp having two ends; a reflector in which the lamp is arranged with its longitudinal axis in the reflector axis, the reflector having a neck at one end and a light emission aperture at the other end thereof; a base made of a temperature resistant electrically insulating material, and being connected to one lamp end and to the reflector neck; and an end ring made of a temperature resistant, electrically insulating material, and being connected to the reflector at the light emission aperture thereof. Further provided is means for connecting the end ring to the second lamp end with the second lamp end facing the light emission aperture of the reflector, the base and the end ring having shoulders and recesses and the connections between the lamp and the base and end ring defining free vent openings for passage of cooling air. A pair of electrical connection members are provided, each respectively being associated with the base and with the end ring and which are rigidly connected to them, the electrical connection member of at least the base being external of the reflector; and the connecting means between the second lamp end and the end ring comprises a lead-in wire of the lamp which extends from the second lamp end substantially radially to at least one of the reflector and end ring, the lead-in wire then extending directly to the connection member associated with the end ring.

BRIEF DESCRIPTION OF THE DRAWINGS

The invention will now be described by way of the accompanying Figures which illustrate schematically a preferred practical example of an assembly comprising a high pressure discharge lamp and a reflector as a structural unit, and in which.

DETAILED DESCRIPTION

Figure 1:
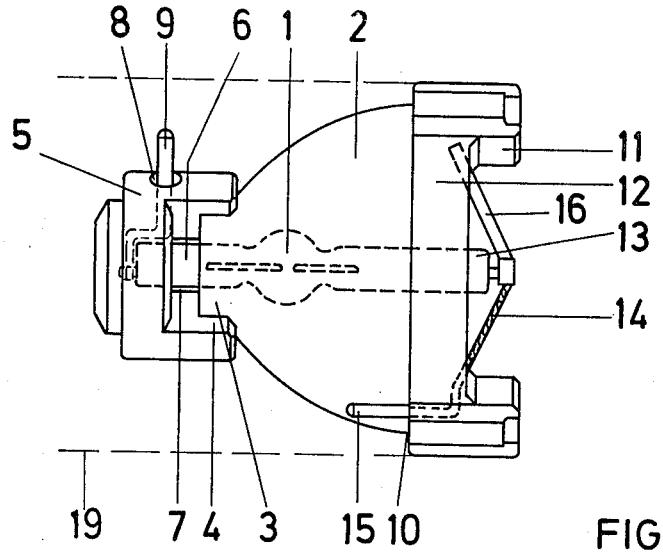
FIG. 1 shows the assembly in side view.
Figure 2:
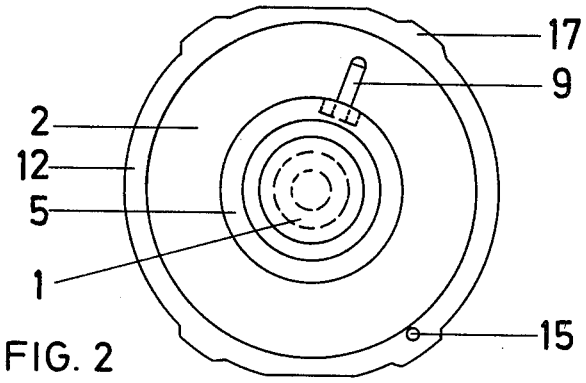
FIG. 2 shows the assembly in the direction of the longitudinal axis looking toward the base.
Figure 3:
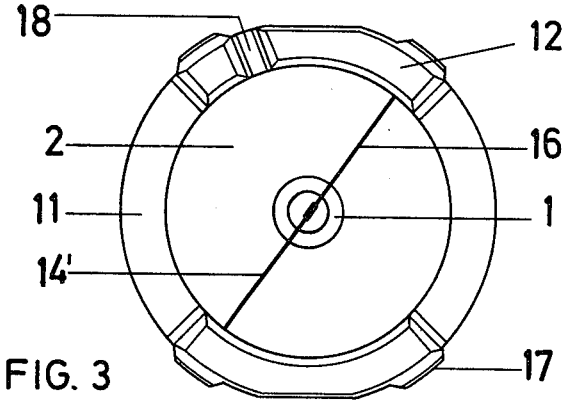
FIG. 3 shows a modified assembly in the direction of the longitudinal axis looking toward the end ring.

The assembly illustrated in FIGS. 1 to 3 comprises a metal halide lamp 1 (rated wattage 250 W), which is operated from an alternating current power source and which comprises one bulb only; and a pressed glass reflector 2 which is preferably provided with an interference edge filter. A base 5 made of ceramic material comprising recesses 4 is cemented to the outside of reflector neck 3. The lamp 1 is also fixed with its first end 6 to the base 5, however, at a different location, whereby vent openings 7 result. A hollow pin 9 is affixed, for example by cementing, in a recess 8 of the base 5 in a non-removable and twistproof manner. The lead-in wire of the first lamp end 6 is secured in the hollow pin 9 by a clamp-type connection.

An end ring 12 made of ceramic material and provided with recesses 11 is cemented to the front of the glass reflector 2 at its light emmission aperture 10. Thus, cooling air generated by a fan in the projector may flow past the lamp 1 through the recesses 4 in the base 5, through the vent openings 7 and through the recesses 11 in the end ring 12.

The second lamp end 13 facing the light emission aperture 10 of the reflector 2 is welded to a lead-in wire 14 which is passed directly through an opening in the end ring 12 and is clamped in the hollow pin 15 arranged parallel to the lamp and reflector axis. The hollow pin 15 is secured in a recess of the end ring 12 in a non-removable and twistproof manner (i.e., by cementing) so that it is arranged within an assumed jacket cylinder 19 formed by the diameter of the end ring 12. The pins 9 and 15 are different in diameter, thus permitting a defined connection of the supply leads and preventing erroneous connections.

The lead-in wire 14, in the illustrated embodiment, is designed as a flat, nickel-plated copper strand. The metal strip 16 (nickel-plated copper strip) which is also welded to the second lamp end 13 and terminates in an opening in the end ring 12 serves as a heat dissipating member and at the same time as a support of the second lamp end 13 facing the light emission aperture 10 of the reflector 2, respective ends of the lead-in wire 14 and of the metal strip 16 being arranged diametrically opposite relative to the reflector 2 and to the end ring 12, respectively. The end ring 12 with the recesses 11 comprises, in addition, precise adjustment cams 17 (FIGS. 2 and 3) at its circumference and a positioning groove or cut-out 18 (FIG. 3) on its front surface.

The connection members 9,15 are designed as hollow pins of different diameters to increase electrical security, and are firmly anchored, preferably cemented, in corresponding recesses of the base 5 and of the end ring 12. The pins 9,15 and/or their corresponding counterparts are, in addition, so constructed that a sufficiently high force preventing detachment is acting thereon.

The lead-in wire extending from the second lamp end 13 facing the light emission aperture 10 of the reflector 2 and extending radially to the end ring 12 is passed through an opening in the end ring 12 directly to the connection member 15 and joined thereto in contacting manner, e.g., by soldering or clamp-fitting. When hollow pins 15 are used, a clamp connection is particularly advantageous. Various types of lead-in wire can be used. For example a flexible stranded cable enables precise adjustment of the lamp relative to the reflector; a metal strip 14' as a lead-in wire improves heat dissipation and at the same time mechanically supports the second lamp end 13. In a specific embodiment of FIG. 1, the lead-in wire is a flattened stranded cable 14; in addition, at least one metal strip 16 extends radially to the end ring 12, the lead-in wire 14 and the metal strip 16 being arranged diametrically to the reflector. In such a construction, the shading in the direction of the path of radiation may practically be neglected. In a modified embodiment of FIG. 3, the lead-in wire is a metal strip 14' of the same type as the metal strip 16 which extends radially to the ring 12, the lead-in wire 14' and the metal strip 16 again being arranged diametrically to the reflector.

In the assembly comprising the structural unit in accordance with the invention, the pins 9, 15 are rigidly connected to the base and to the end ring, respectively, and do not project from a supposed jacket cylinder 19 having a diameter defined by the end ring 12 diameter. This pin assembly permits space-saving accommodation of the reflector unit in projectors (such as movie or slide projectors) where only little space is available. Confusion as to the connection leads is prevented by the different pin diameters. When hollow pins are used, the connection of the lead-in wire to the pins may be effected at especially low cost by simple clamping. It also enables firm clamp connection of a lamp cord at a later time. The radial lead-in wire 14 passed directly to the connection member 15 increases the mechanical integrity and strength of the assembly. The use of a stranded cable as a lead-in wire and of a metal strip 16 as a heat dissipating member permits ready adjustment of the lamp and simultaneous mechanical support of the lamp end 13 facing the light emission aperture 10 of the reflector 2.

I claim:

1. A lamp assembly comprising:

a high pressure discharge lamp (1) having a first and a second end (6, 13);

a reflector (2) in which the lamp (1) is arranged with its longitudinal axis in the reflector axis, the reflector (2) having a neck (3) at one end and a light emission aperture (10) at the other end thereof;

a base (5) made of a temperature resistant electrically insulating material, and having connections to said first lamp end (6) and to the reflector neck (3);

an end ring (12) made of a temperature resistant, electrically insulating material, and having a connection to said reflector (2) at said light emission aperture (10);

support and connecting means (14, 14', 16) coupled between said second lamp end (13) and said end ring (12) for connecting said second lamp end (13) to said end ring (12) with said second lamp end (13) facing said light emission aperture (10) of said reflector (2);

said base (5) and said end ring (12) having shoulders and recesses and said connections between said lamp and said base and end ring defining free vent openings for passage of cooling air;

a pair of electrical connection members (9, 15) each respectively associated with said base and with said end ring;

said electrical connection member (9) of at least said base being external of said reflector (2); and said support and connecting means coupling said second lamp end (13) to said end ring (12) comprising a lead-in wire (14) of said lamp which extends from said second lamp end (13) substantially radially of said light emission aperture to at least one of said reflector (2) and end ring (12), said lead-in wire being connected to said connection member (15) associated with said end ring (12) to electrically interconnect said second lamp end (13) to said connection member (15) associated with said end ring; and a support member (16) connected to support said second lamp end (13) relative to said end ring (12);

said electrical connection members (9, 15) being formed of rigid materials and being rigidly connected to said base (5) and to said end ring (12), respectively, in order to increase the mechanical integrity and electrical security of the assembly; and said lead-in wire (14) extending along a substantially straight line from said second lamp end (13) directly to said end ring (12), said support member (16) supporting said second lamp end (13) relative to said end ring (12) and retaining said second lamp end (13) in position relative to said end ring (12), and said lead-in wire (14) being connected directly to said connection member (15) associated with said end ring (12).

2. A lamp assembly comprising:

a high pressure discharge lamp (1) having a first end and a second end (6,13);

a reflector (2) in which the lamp (1) is arranged with its longitudinal axis in the reflector axis, the reflector (2) having a neck (3) at one end and a light emission aperture (10) at the other end thereof;

a base (5) made of a temperature resistant electrically insulating material, and having connections to said first lamp end (6) and to the reflector neck (3);

an end ring (12) made of a temperature resistant, electrically insulating material, and having a connection to said reflector (2) at said light emission aperture (10);

support and connecting means for connecting said end ring (12) to the second lamp end (13) with said second lamp end (13) facing said light emission aperture (10) of said reflector (2);

said base (5) and said end ring (12) having shoulders and recesses and said connections between said lamp and said base and end ring defining free vent openings for passage of cooling air;

a pair of electrical connection members (9, 15) each respectively associated with said base and with said end ring and which are rigidly connected to them;

said electrical connection member of at least said base being external of said reflector (2); and the support and connecting means between said second lamp end (13) and said end ring (12) comprising a lead-in wire (14) of said lamp which extends from said second lamp end (13) substantially radially of said light emission aperture to both said end ring (12) and to said reflector (2), said lead-in wire then extending directly to said connection member (15) associated with said end ring (12) to electrically interconnect said second lamp end (13) with said connection member (15) associated with said end ring (12), and a support member (16) connected to support said second lamp end (13) relative to said end ring (12) and reflector (2).

3. The assembly of claim 1, wherein the connection members (9,15) are both arranged within an imaginary jacket cylinder (19) which is formed by the outer diameter of said end ring (12) and which extends axially of said assembly.

4. The assembly of any one of claims 1, 2 or 3, wherein said connection member (15) extending from said end ring (12) is elongated and has a longitudinal axis which extends from said end ring and which runs substantially parallel to the longitudinal axis of said lamp (1) and reflector (2).

5. The assembly of claim 4, wherein said connection member (9) extending from said base is elongated and has a longitudinal axis which extends from said base substantially perpendicular to the longitudinal axis of said lamp (1) and reflector (2).

6. The assembly of any one of claims 1, 2 or 3, wherein said connection member (9) extends from said base is elongated and has a longitudinal axis which extends from said base substantially perpendicular to the longitudinal axis of said lamp (1) and reflector (2).

7. The assembly of any one of claims 1, 2 or 3, wherein said connection members (9,15) are pins having different diameters.

8. The assembly of claim 7, wherein said pins are hollow pins.

9. The assembly of any one of claims 1, 2 or 3, wherein said lead-in wire extending substantially radially from said second lamp end (13) comprises a stranded cable (14).

10. The assembly of any one of claims 1, 2 or 3, wherein said lead-in wire extending substantially from said second lamp end (13) comprises a metal strip (14').

11. The assembly of any one of claims 1, 2 or 3 wherein said support member comprises at least one substantially rigid connection means (16) between said second lamp end and said end ring, said substantially rigid connection means (16) including a substantially straight metal strip which is arranged substantially radially to said reflector (2) and to said end ring (12), and which is affixed to the said end ring (12).

12. The assembly of claim 1 or 2, wherein said support member of said support and connecting means further comprises a substantially rigid metal strip (16) extending between said second lamp end (13) and said end ring (12) substantially radially of said light emission aperture and being connected to said end ring (12) to support said second lamp end (13), said substantially rigid metal strip extending in the opposite direction from said lead-in wire (14) so as to extend, in cooperation with said lead-in wire (14) along a diameter of said light emission aperture.

* * * * *